US007281520B2

(12) United States Patent
Klenk et al.

(10) Patent No.: US 7,281,520 B2
(45) Date of Patent: Oct. 16, 2007

(54) ARRANGEMENT FOR SUPPLYING FUEL TO THE FUEL INJECTORS OF AN INTERNAL COMBUSTION ENGINE

(75) Inventors: Rolf Klenk, Stuttgart (DE); Martin Matt, Untergrombach (DE); Hans-Karl Weining, Esslingen (DE); Klaus Wunderlich, Waiblingen (DE)

(73) Assignee: DaimlerChrysler AG, Stuttgart (DE)

( * ) Notice: Subject to any disclaimer, the term of this patent is extended or adjusted under 35 U.S.C. 154(b) by 153 days.

(21) Appl. No.: 11/067,468

(22) Filed: Feb. 25, 2005

(65) Prior Publication Data

US 2005/0188958 A1 Sep. 1, 2005

(30) Foreign Application Priority Data

Feb. 28, 2004 (DE) ..... 10 2004 009 792

(51) Int. Cl.
*F02M 63/00* (2006.01)

(52) U.S. Cl. ..... 123/446; 123/447; 123/467

(58) Field of Classification Search ..... 123/446, 123/447, 510, 511, 497
See application file for complete search history.

(56) References Cited

U.S. PATENT DOCUMENTS 4,827,897 A * 5/1989 Yamada et al. ..... 123/497
6,253,739 B1 * 7/2001 Golomb et al. ..... 123/509
6,314,947 B1 * 11/2001 Roche ..... 123/525
6,397,819 B1 * 6/2002 Rembold et al. ..... 123/456
6,527,603 B1 * 3/2003 Wickman et al. ..... 440/88 F
6,536,415 B2 * 3/2003 Joos et al. ..... 123/497
6,694,955 B1 * 2/2004 Griffiths et al. ..... 123/516
6,889,656 B1 * 5/2005 Rembold et al. ..... 123/446
6,971,373 B2 * 12/2005 Mudway et al. ..... 123/497

FOREIGN PATENT DOCUMENTS

| | | |
|---|---|---|
| DE | 195 39 885 | 11/1996 |
| DE | 199 39 051 | 2/2001 |
| DE | 100 05 589 | 8/2001 |
| DE | 101 27 516 | 12/2002 |

* cited by examiner

*Primary Examiner*—Thomas Moulis
(74) *Attorney, Agent, or Firm*—Klaus J. Bach

(57) ABSTRACT

In a fuel supply arrangement for supplying fuel from a fuel tank to the fuel injectors of an internal combustion engine by an electrically operated fuel pump, a first fuel pressure level adequate for normal engine operation is provided by the fuel pump and means are provided for increasing the fuel injection pressure provided by the pump for supplying fuel at a higher pressure level to the fuel injectors during an engine start-up or warm-up phase.

12 Claims, 12 Drawing Sheets

ARRANGEMENT FOR SUPPLYING FUEL TO THE FUEL INJECTORS OF AN INTERNAL COMBUSTION ENGINE

BACKGROUND OF THE INVENTION

The invention relates to an arrangement for supplying fuel to the fuel injectors mounted onto the cylinder heads of an internal combustion engine wherein fuel is supplied to the injectors by a pumping device through a pressure line under a static pressure.

Methods and fuel supply arrangements are known wherein fuel is pumped by a pump arrangement, which comprises at least one fuel pump, from a fuel tank through a pressure line under a certain pressure to the injectors of an internal combustion engine so as to be available for injection into the combustion chambers of the engine. A device for increasing the fuel injection pressure may be provided for improving the mixture formation by improving the atomization of the fuel spray during fuel injection. Particularly during the startup period of the internal combustion engine, a controllably dosed fuel amount can be provided for the first combustions in order to avoid fuel film depositions on the walls and to form a homogeneous fuel mixture, which can burn with relatively little emissions whereby the overall exhaust gas emissions from the engine can be reduced.

DE 101 27 516 A1 discloses a method, wherein, for the start-up period of the internal combustion engine, the fuel is supplied with a pressure of 45 bar to 55 bar. To this end, a fuel supply arrangement is provided wherein an engine-driven fuel pump generates a static injection pressure in a fuel line to which the injectors of the internal combustion engine are connected. Since during shut-down of the internal combustion engine, the high fuel pressure in the fuel supply line is disadvantageous, the pressure is released. In order to rapidly establish operating pressure upon engine startup thereby to improve the exhaust gas emissions, in the known fuel supply system, an additional electrically operated fuel pump is provided, which supplies fuel directly into the main fuel line and which is switched on during the engine start up procedure for providing the increased fuel pressure. DE 101 27 516 A1 proposes an arrangement with two serially arranged fuel pumps of different performance, wherein the fuel pumped by the first pump is fed by a high pressure pump into the fuel supply line. In this known arrangement, the mechanical drive of the fuel pumps can be disconnected from the engine drive by a switchable clutch and can be coupled to an electric drive in order to be able to utilize the high pressure pump for increasing the fuel pressure during the engine startup phase. This known arrangement requires substantial expenses in order to connect a device for increasing the fuel injection pressure since either a pump must be provided exclusively for the startup phase or in a staged pressure generation by means of a low-pressure and a high pressure pump, an expensive clutch or coupling arrangement must be provided for increasing the fuel injection pressure.

DE 100 05 589 A1 discloses a fuel supply arrangement wherein a pressure controller adjusts the injection pressure as needed by the internal combustion engine selectively to different pressure levels. Herein, in order to facilitate a safe hot start up of the internal combustion engine, the fuel pressure is increased for a short period in order to counteract vapor formation in the warm fuel. The arrangement provides for a fuel pressure of 3.5 bar for high fuel requirements and an increased pressure of 6 bar for hot startup operations which is generated by two serially arranged fuel pumps, each of which generates a pressure of 3 bar and which can be arranged in parallel or in series.

DE 199 39 051 A1 discloses a method using an additional fuel pump for generating the required high fuel pressure during the engine startup phase. The additional fuel pump is electrically operated and electrically switchable and supplies fuel directly into the pressure line, so that, during the startup phase in which the mechanically operated pump cannot yet supply the required high pressure level in the pressure line, an essentially higher pressure is available. The additional electric pump is arranged in parallel with the mechanical pump and is also operated during normal engine operation so as to contribute to providing a high fuel pressure.

DE 195 39 885 A1 discloses a method of operating an internal combustion engine and a fuel supply arrangement wherein a first electrically operated displacement pump supplies fuel to a mechanical engine-driven high pressure pump. The displacement pump in this case is to pump more fuel than is required and excess fuel is returned to the tank via a return line. The supply pressure generated is further increased by the high pressure pump so as to provide in the pressure line the required injection pressure. In order to counter the problem of the vapor formation in the fuel lines when, with the internal combustion engine shut down, the pressure in the fuel line drops, the known arrangement interrupts in the startup phase of the engine the return flow of the electric low pressure pump so that the electric displacement pump generates an increased pressure by which the fuel lines are flushed and any steam bubbles are pushed out of the lines. The arrangement does not provide for an increase of the fuel pressure when needed for improved atomizing of the injected fuel jet under certain operating conditions beyond the normal operating level.

It is the object of the present invention to provide, with the least possible expenditure, a fuel supply arrangement with which, without limitations for the normal operation, the fuel injection pressure can be increased during the start-up phase of the internal combustion engine and the fuel injection volume can be accurately controlled.

SUMMARY OF THE INVENTION

In a fuel supply arrangement for supplying fuel from a fuel tank to the fuel injectors of an internal combustion engine by an electrically operated fuel pump, a first fuel pressure level adequate for normal engine operation is provided by the fuel pump and means are provided for increasing the fuel injection pressure provided by the pump for supplying fuel at a higher pressure level to the fuel injectors during an engine start-up or warm-up phase.

With this arrangement, only a limited performance for this high pressure electrical pump is required to obtain a sufficiently high fuel pressure for a good atomization of the fuel in the combustion chamber. Depending on certain conditions, the startup phase is then terminated and the fuel pressure is lowered to a level of about 3 bar to 5 bar.

In one embodiment, the fuel supply arrangement includes a low pressure fuel pump with a high pressure pump arranged in series therewith which can selectively be switched on for increasing the fuel injection pressure. In a section of the high pressure line downstream of the high pressure pump a relief line is connected to the pressure line and is connected at its other end to a low pressure section of the fuel line upstream of the high pressure pump. The relief line includes a switchable relief valve structure so that, by closing the relief valve, the pressure level is increased by activating the high pressure pump. In this way, with simple means, an arrangement is provided in which, with a simple valve structure, the high pressure pump can be switched in and by opening the valve structure the low pressure level of the upstream fuel pump can be provided. The valve structure may be a magnetic valve, which, under normal operation is de-energized, that is open and, for activating the high pressure pump for increasing the fuel pressure, is closed. Expediently, the high pressure pump is operated electrically and therefore can immediately provide the high fuel pressure level in the pressure line of the injectors upon start-up of the engine.

If the high pressure pump is provided with a by-pass line which includes a check valve, with a shut down of the electric high pressure pump, fuel injection is still ensured for an emerging operation if the magnetic valve fails.

In an alternative embodiment of the fuel supply arrangement, a pressure storage device may be provided so as to be connectable, by way of a connecting line with a valve, to the suction side of the fuel pump in the fuel supply line upstream of the fuel pump, whereby, with an opening of the connecting line, an increased pressure level can be instantly established. Such a fuel supply arrangement may be quite compact by supplying fuel to the pressurized fuel storage device from a fuel supply line which is connected to the fuel pressure line downstream of a pressure control device arranged in the pressure line. The relief line of the pressure controller which is adapted to the low pressure level is closed, whereby the fuel pump generates a pressure level beyond normal pressure when the engine consumes a relatively small amount of fuel. For controlling the injection pressure in the operating phase with an increased injection pressure in the operating phase an advance control by a variable throttle in the connecting line of the pressure storage device is expedient.

The pressure storage device can preferably be controlled by means of a control unit which also controls the injectors, the control unit being in communication with pressure sensors at the pressure storage device and in the pressure line. With a possible drop of the preliminary pressure of the pressure storage device or, respectively, a drop of the high pressure to the low normal pressure, the injection times of the injectors are adapted to the available injection pressure for an optimal injection result using stored performance graph data. In a preferred embodiment of the invention, a controllable fuel pump is provided which is controlled by the control unit taking into consideration the pressure available from the pressure storage device, so that the fuel injection process can be accurately adjusted.

In a very compact fuel supply arrangement, the pumping device for supplying the fuel under a certain pressure and an increased pressure when needed is a pump which is controllable on the basis of the desired injection pressure, since additional equipment for increasing the fuel injection pressure is then not needed. It is in this connection expedient if a controllable pressure control valve is arranged in the pressure line in order to obtain the desired pressure level. A rapid pressure drop during switch-over from high pressure operation to low pressure operation is possible if a vent line extends from the pressure line which can be opened by a valve.

The invention will become more readily apparent from the following description thereof on the basis of the accompanying drawings.

DESCRIPTION OF PREFERRED EMBODIMENTS

Figure 1A:
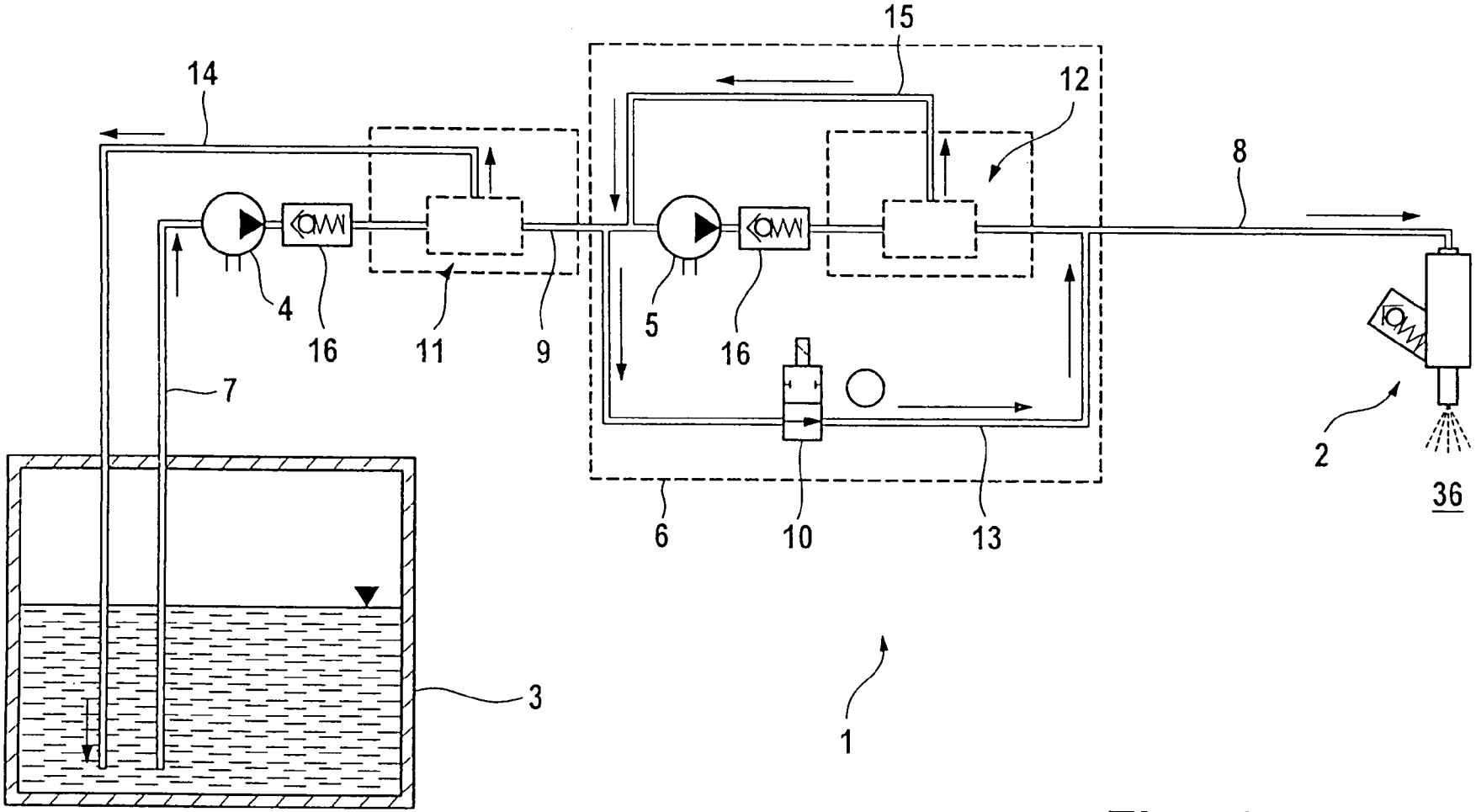
FIGS. 1*a* to 1*c* show schematically flow circuits for a fuel supply arrangement with two fuel pumps.
Figure 1B:
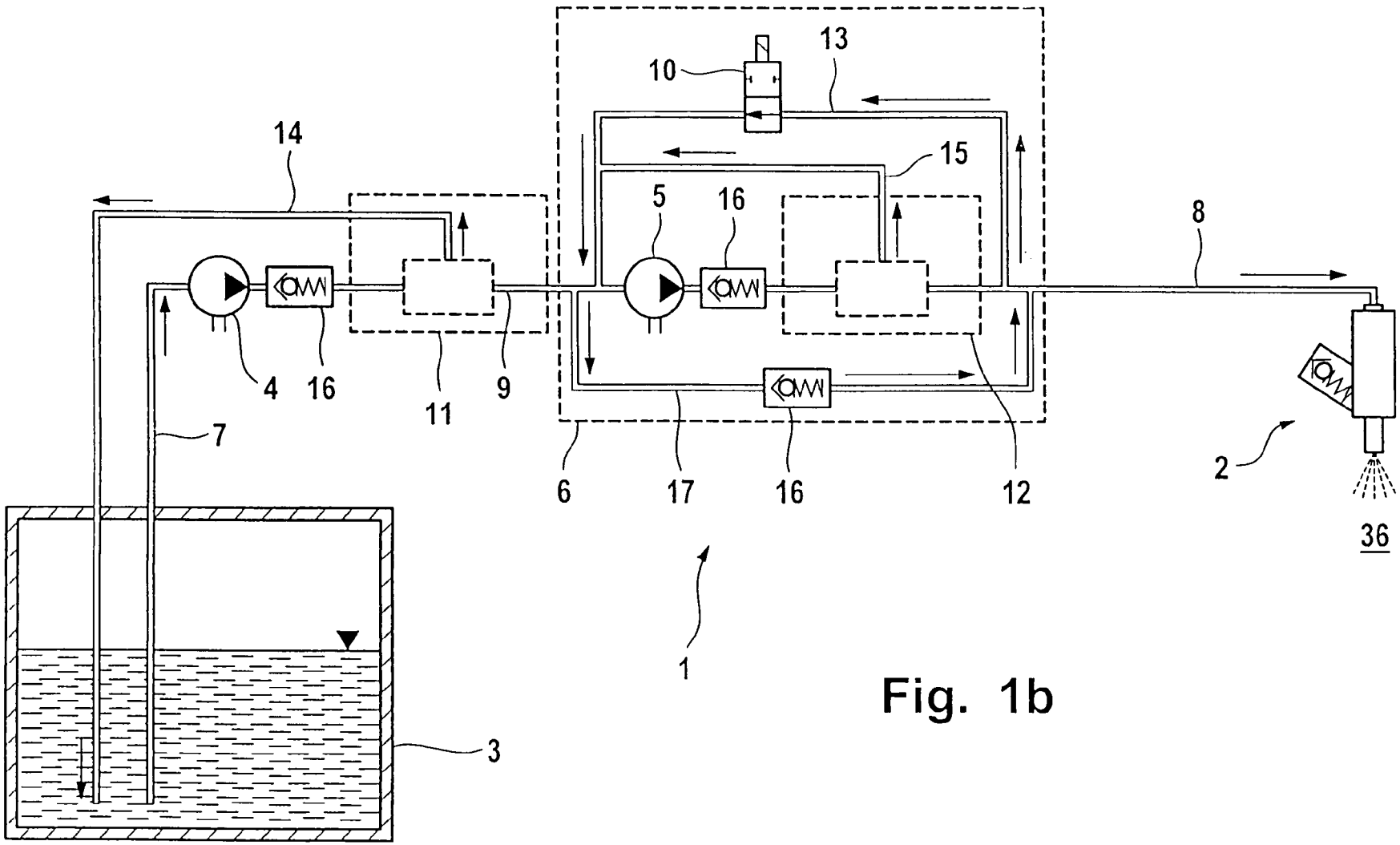
Figure 1C:
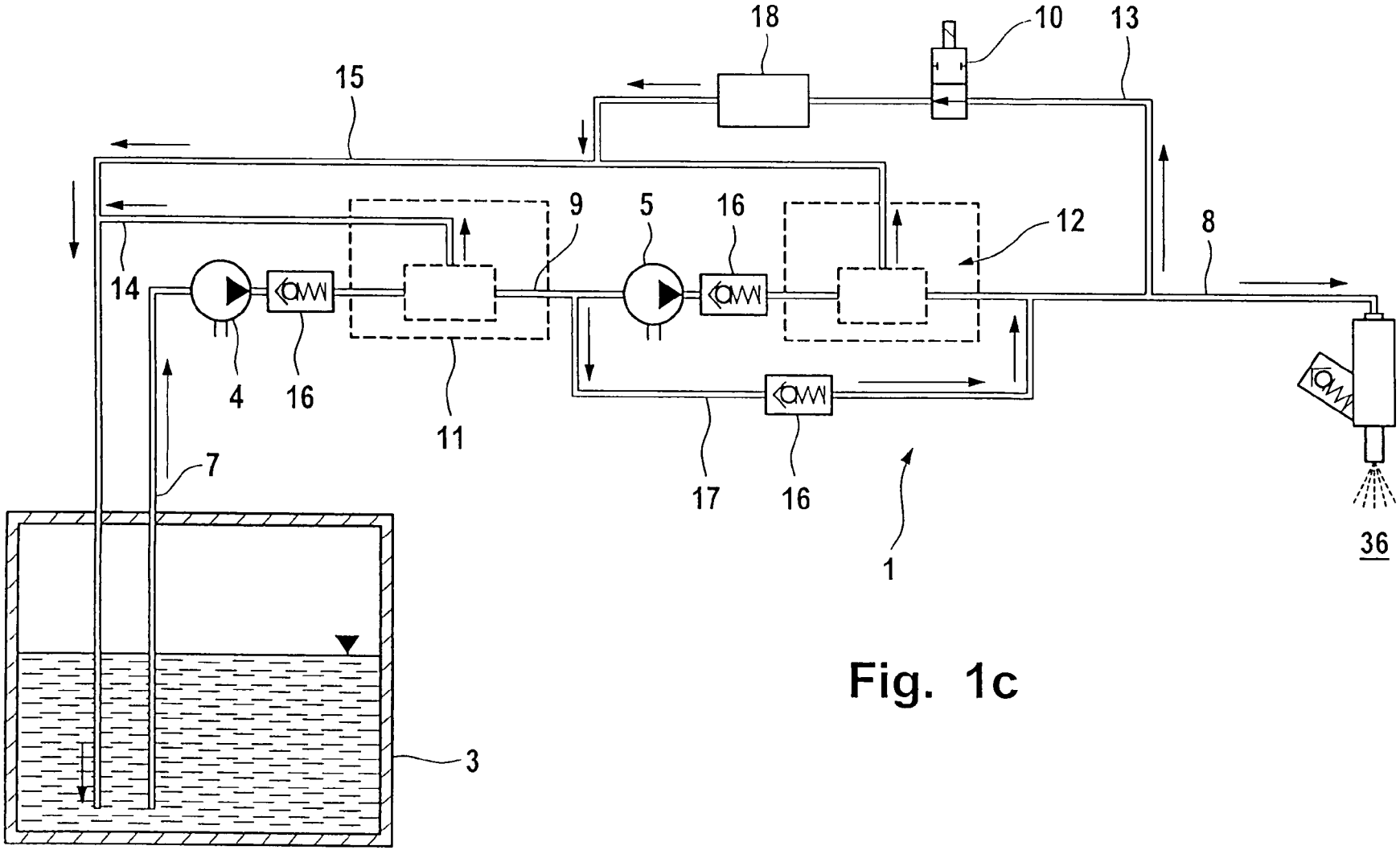

FIGS. 1*a*-1*c* show a fuel supply arrangement 1 for supplying fuel to the injectors 2 extending into the combustion chamber 36 of an internal combustion engine. The fuel supply arrangement 1 comprises a pumping device which, by way of a supply line 7, provides fuel from a fuel tank 3 to a pressure line 8 under a certain pressure for the injection of the fuel into the combustion chamber. The pressure line 8 is connected to injectors 2 for supplying the fuel thereto, wherein the end of the pressure line 8 is in the form of a common rail via which all the injectors 2 are supplied with fuel. The pump arrangement comprises an electric fuel pump 4 whose input is connected to the supply line 7 extending from the fuel tank 3. The fuel pump 4 is designed for an injection pressure as needed for normal engine operation which in the present embodiment is 3.8 bar. The pumping arrangement furthermore includes a device 6 for increasing the pressure which is connectable for increasing the operating pressure in the pressure line as supplied by the fuel pump 4 when needed.

The switchable device 6 includes as means for increasing the pressure an electrically operated fuel pump 5, which is designed for a higher operating pressure than the fuel pump 4 and which is arranged in series with, and downstream of, the fuel pump 4. The increased pressure of the high pressure pump 5 is in the range of about 10 bar to 15 bar, in the present case 14 bar. The increased operating pressure is controllable by a pressure release line 13 with a switchable magnetic valve 10. The release line 13 branches off the pressure line 8 upstream of the high pressure pump 5 and leads to a low pressure section of the fuel supply line. The magnetic valve 10 is open under normal operating conditions and holds the injection pressure of the fuel in the pressure line to the injectors at the operating pressure of the low pressure line of about 3 bar to 5 bar, in the present example at 3.8 bar. In order to provide the fuel with the increased pressure, the magnetic valves 10 and consequently the release line 13 are closed and, at the same time, the high pressure pump 5 is switched on so that the high pressure pump 5 instantly increases the fuel pressure in the pressure line 8.

The low pressure pump 4 as well as the high pressure pump 5 are each provided with a pressure controller 11, 12 arranged downstream of the respective pump and a return line 14 is connected to the pressure controller for the lower pressure pump 4 for returning fuel to the tank 3. From the pressure controller 12 for the high pressure pump 5, a return line 15 extends to the section of the pressure line 8 between the fuel pumps 4 and 5. Between the fuel pumps 4 and 5 and the respective downstream pressure controllers 11, 12 check valves 16 are arranged which prevent backflow of the pressurized fuel.

In the fuel supply arrangement according to FIG. 1*b*, the connectable arrangement for increasing the pressure 6 includes, in addition to the fuel release line 13, a bypass line 17 provided with a check valve 16 for bypassing the high pressure pump 5. The bypass line 17 permits emergency operation if the magnetic valve 10 in the release line 13 cannot be opened. In the embodiment according to FIG. 1*a*, the increased injection pressure of 14 bar is generated in the pressure line 8 by switching the two fuel pumps 4 and 5 and the magnetic valve 10 on. The pressure reduction from 14 bar to the normal pressure is achieved by switching the high pressure pump 5 and the magnetic valve 10 off. In the embodiment according to FIG. 1*b* with an increased pressure level in the pressure line 8 during operation, the magnetic valve 10 is switched off. For switching over to the lower operating pressure, the high pressure pump 5 is switched off and for accelerating the pressure reduction, the magnetic valve 10 is energized. During normal operation with a reduced injection pressure, the magnetic valve can be switched off. In the embodiments according to FIGS. 1*a* and 1*b*, a very compact setup of the fuel supply arrangement 1 is obtained by an integrated structure of the pumps 4 and 5.

The fuel supply arrangement in accordance with FIG. 1*c* comprises a relief line 13 with a magnetic valve 10 arranged therein, the relief line 13 extending to the return line 15 leading to the fuel tank 3. In this arrangement, the pressure can be rapidly reduced from the higher pressure level to the normal pressure level—in comparison with the embodiments shown in FIGS. 1*a* and 1*b*, in which the pressure reduction occurs against the discharge pressure of the low pressure pump 4. In the present embodiment, the fuel discharged for the pressure reduction is conducted to the pressure-free tank 3. The normal pressure in accordance with the nominal pressure of the low pressure pump 4 is ensured by means of a pressure limit valve 18 arranged in the relief line 13. The high pressure pump 5 can be switched off during normal operation at a lower pressure level, in the pressure line 8 since the fuel is conducted through the bypass line 17, which includes a check valve 16.

Figure 2A:
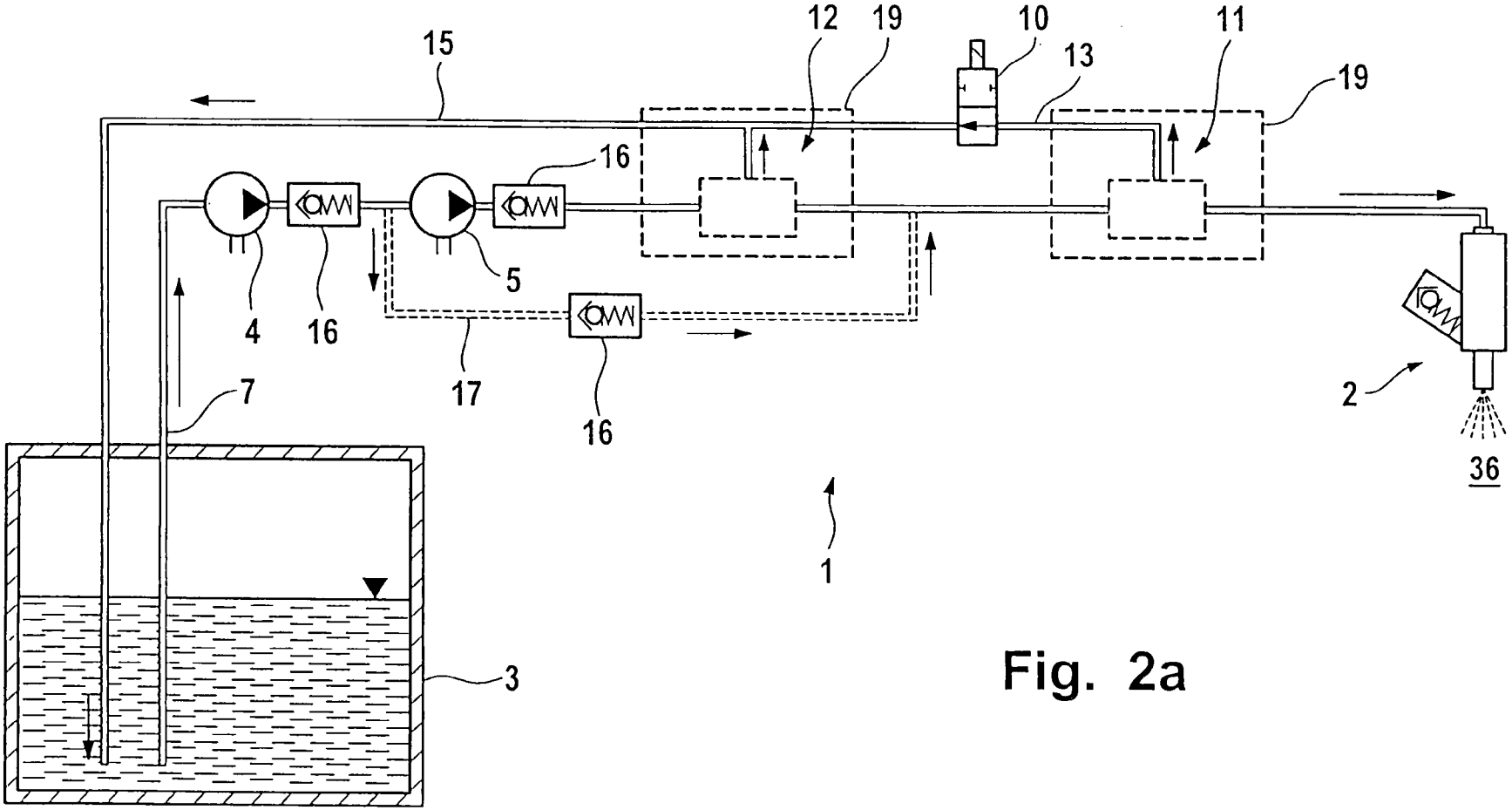
FIGS. 2*a*-2*c* show schematically flow circuits with two fuel pumps and a pressure relief line connected to a pressure controller.
Figure 2B:
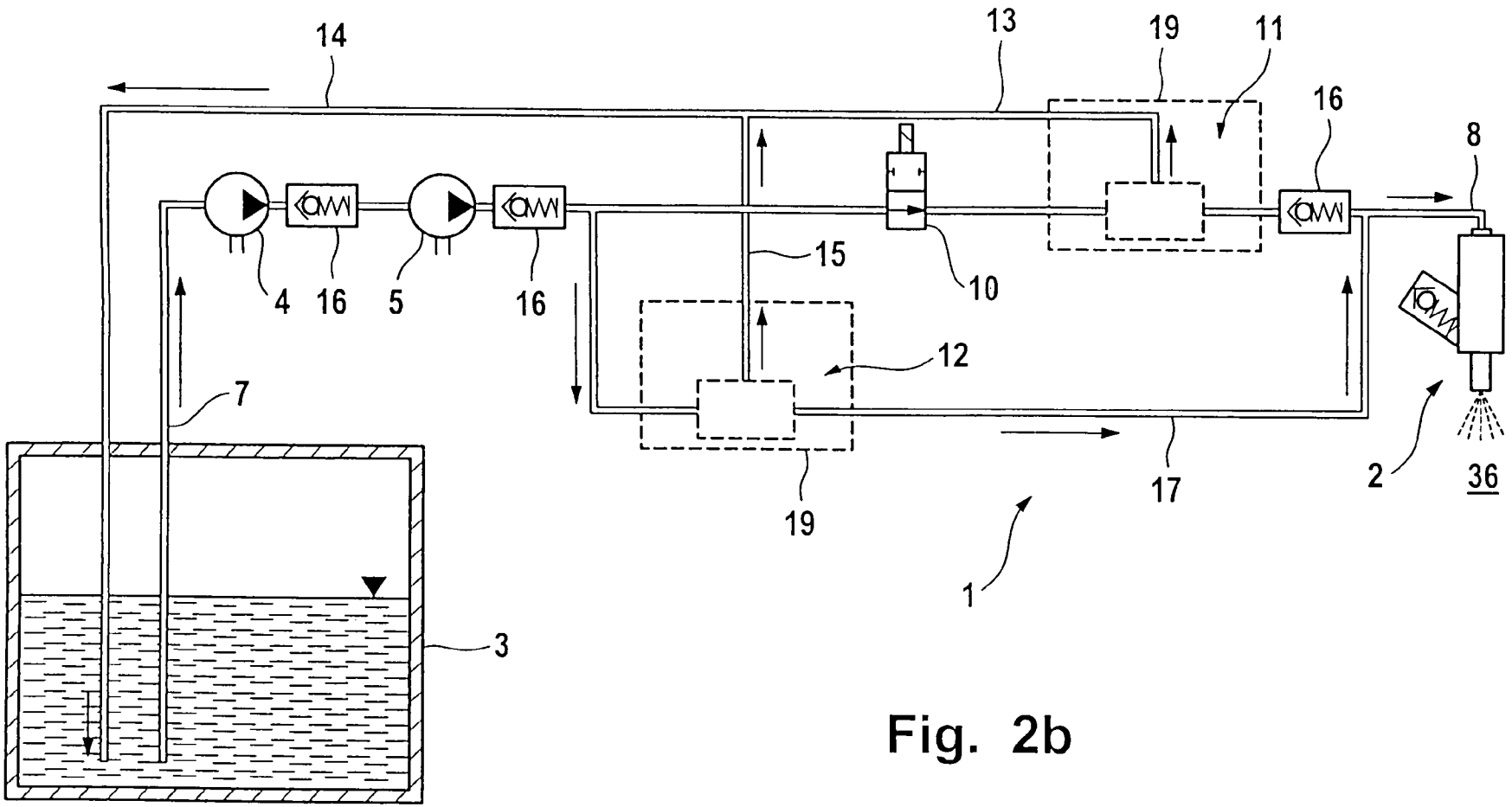
Figure 2C:
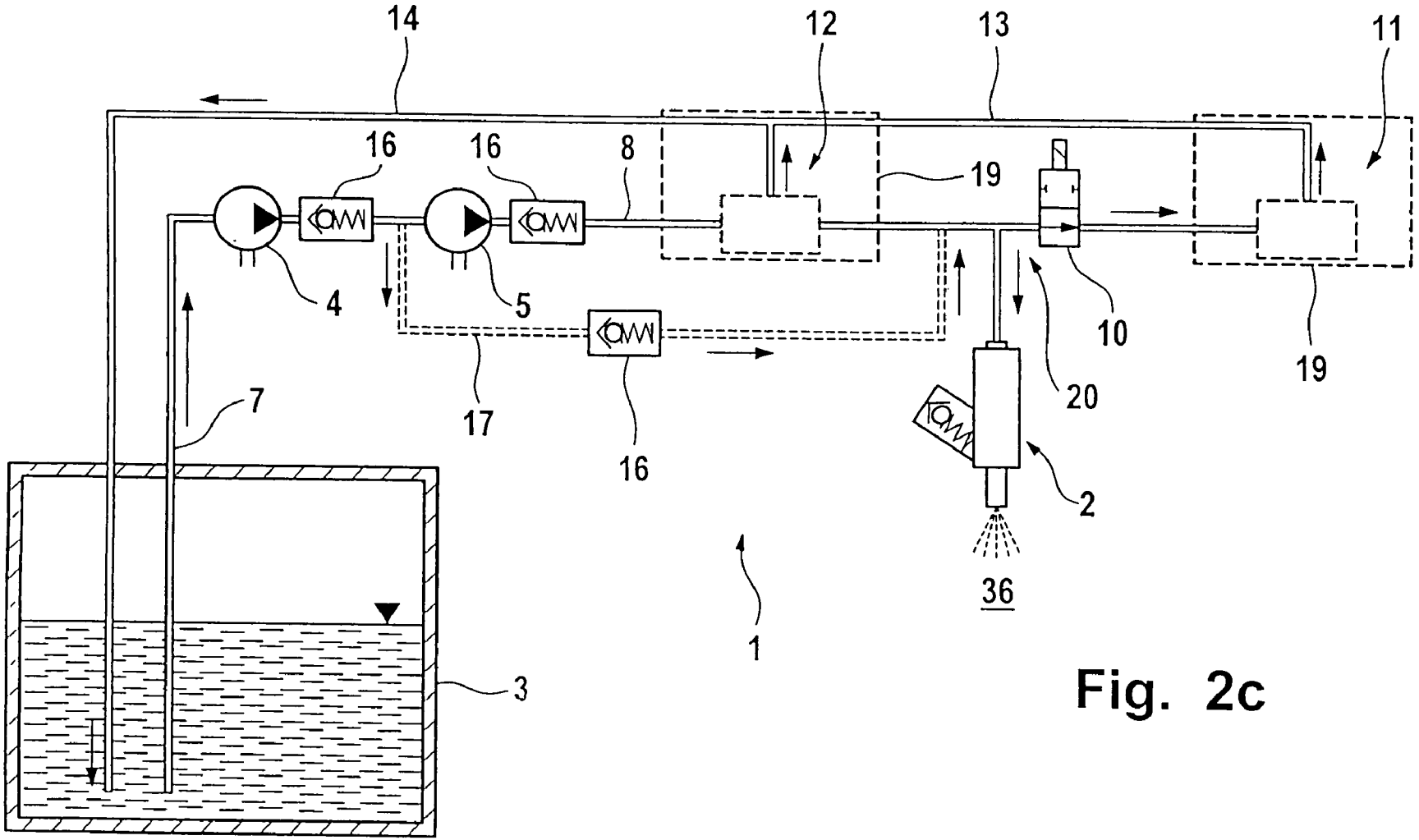

In the embodiments of the fuel supply arrangement according to the invention as shown in FIGS. 2*a*, 2*b* and 2*c* switchable high pressure pumps 5 are arranged serially downstream of the fuel pump 4, which is designed for normal operation, wherein the pressure controllers 11 and 12 are disposed downstream of the fuel pump 4 and 5 for providing the respective pressure level during normal operation and during operation at increased pressures. The pressure controllers 11, 12 may be provided with a fuel filter 19 for filtering the fuel flowing to the injector 2. In the embodiments according to FIGS. 2*a*-2*c*, the high operating pressure controlled by the magnetic valve 10 for opening the relief line 13 is connected to the pressure controller 11 which is designed for the lower injection pressure provided by the low-pressure fuel pump 4. The relief line 13 is at the same time the return line to the fuel tank 3. The magnetic valve 10 can—as shown in FIG. 2*a*—be arranged downstream of the low pressure controller 11 or—as shown in FIGS. 2*b* and 2*c*—upstream of the pressure controller 11. By the connection of the relief line 13 to the pressure-free return line to the fuel tank 3 hysteresis actions are not possible.

With the serial arrangement according to FIGS. 2*a* and 2*b* the bypass line 17 with the check valve 16 permits a shut-down of the high pressure pump 5 during normal operation at a low pressure level in the pressure line 8. In the embodiment according to FIG. 2*b*, the pressure controllers 11, 12 are arranged in parallel branches of the pressure line 8, of which one forms the relief line 13 which can be closed by the magnetic valve 10 for generating the high operating pressure.

The fuel supply system according to FIG. 2*c* is particularly advantageous for injector arrangements with a common rail supplying several fuel injectors 2. In this arrangement, the part of the common rail extending beyond the last of the injectors connected to the common rail up to the free rail end 20 forms the release line for switching to the increased pressure in the pressure line 8. When the magnetic valve 10 is energized to be closed the downstream high pressure pump 5 of the two serially arranged fuel pumps 4, 5 increases the pressure in the pressure line 8.

Figure 3A:
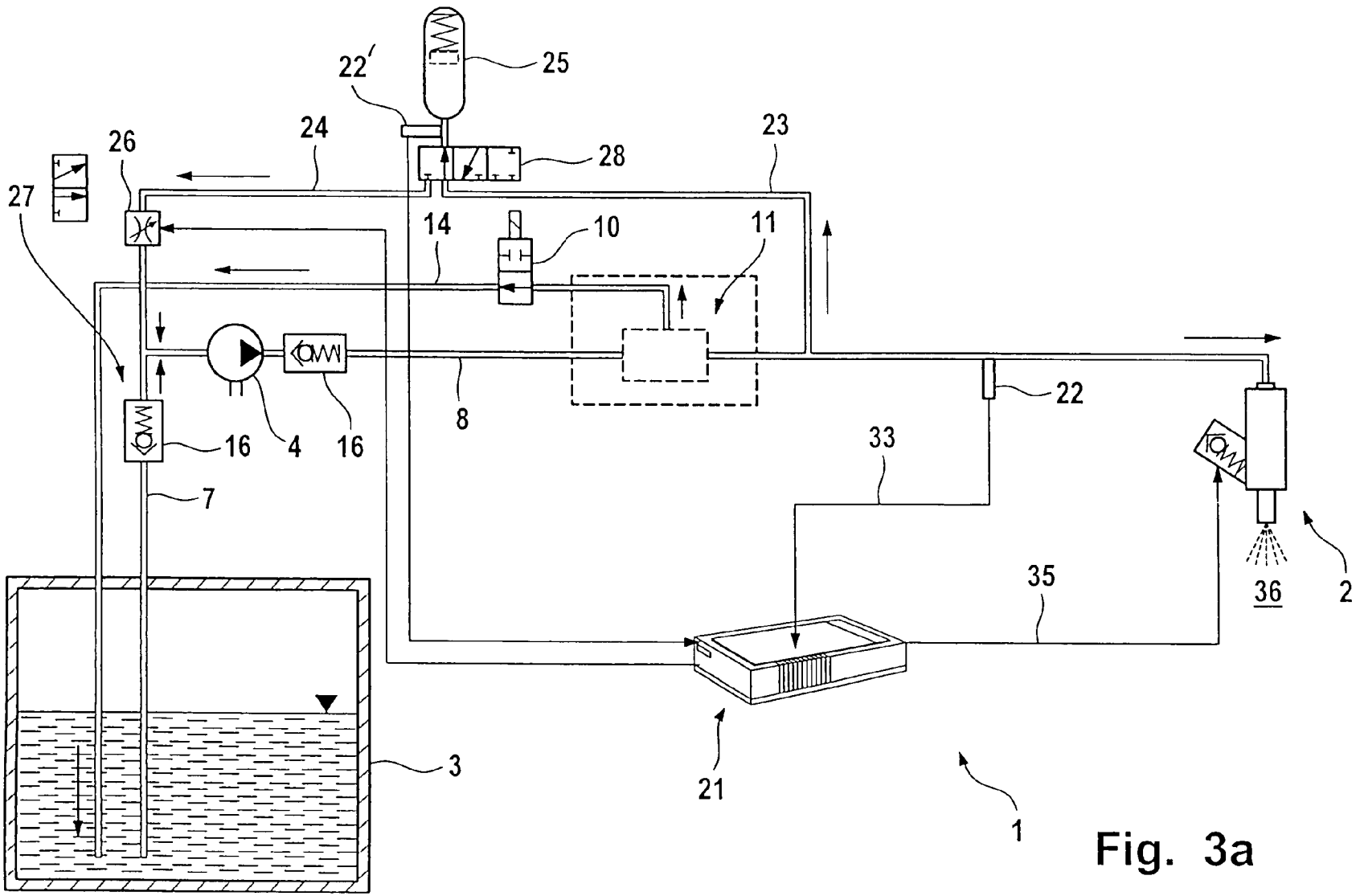
FIGS. 3*a*, 3*b* show schematically circuit arrangements for fuel supply arrangements with a pressure storage device which can be connected to the circuit for increasing the pressure.
Figure 3B:
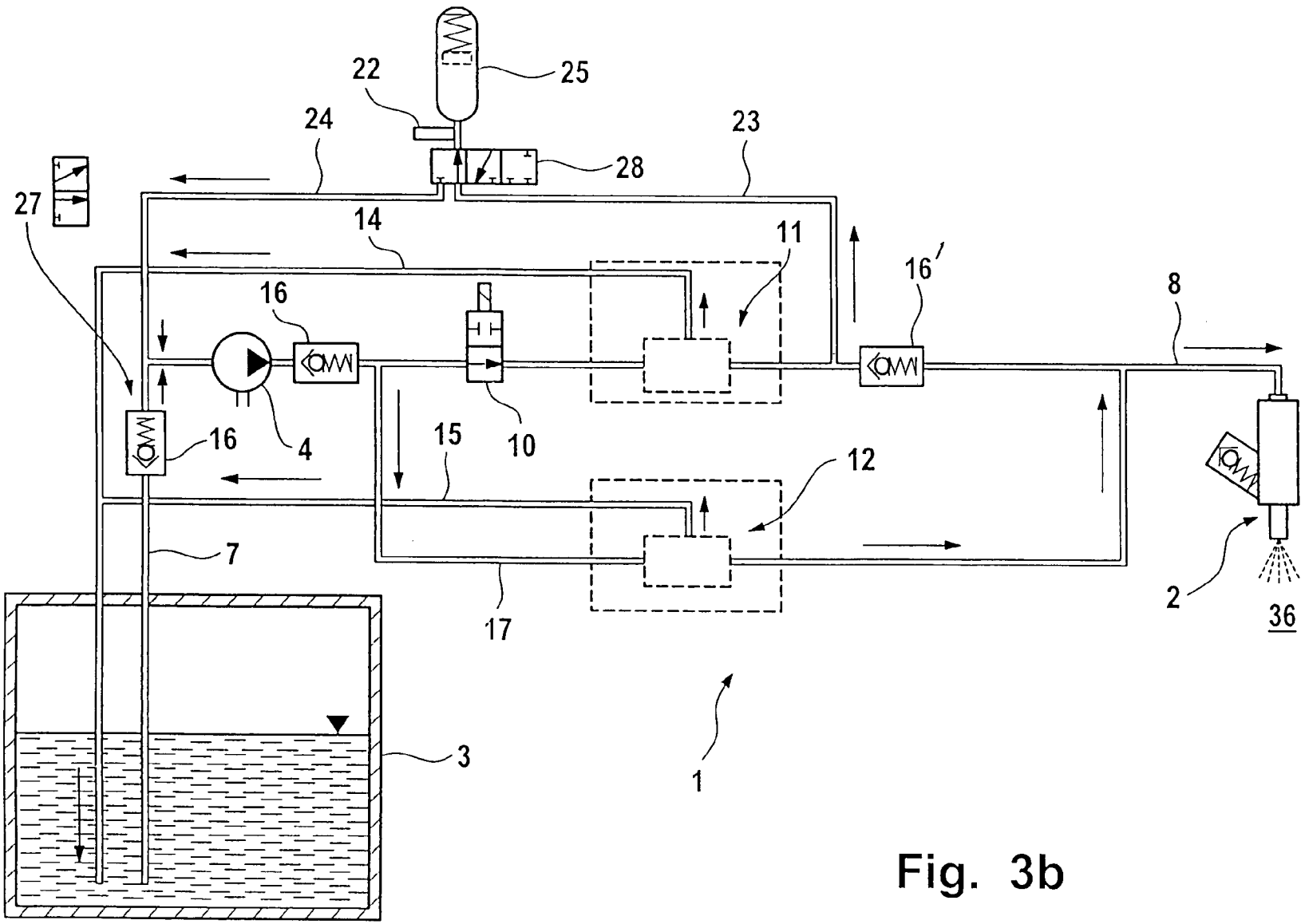

FIGS. 3*a* and 3*b* show a fuel supply arrangement 1 for supplying fuel to the injectors 2 of an internal combustion engine wherein an electric fuel pump 4 is provided in the pressure line 8 for generating the pressure level for normal operation. For increasing the pressure level, a connectable pressure storage device 25 is provided which is connected in the circuit to the supply line 7 via a connecting line 24 and a valve 28 upstream of the fuel pump 4. The arrangement for connecting the pressure storage device 25 may include a check valve 16 in the supply line 7 which prevents backflow of fuel into the pressureless tank 3 when the pressure storage device 25 is connected by the valve 28 to the connecting line 24 for supplying fuel under pressure to the fuel pump 4. The valve for connecting the fuel storage device 25 is preferably a 3/2 way valve whose symbol is shown at the right of the reference numeral 27.

As shown in FIGS. 3*a* and 3*b*, the pressure level can be increased in the inlet area of the fuel pump 4 by the pressure storage device 25 so that the whole pressure level in the pressure line 8 is increased. Downstream of the fuel pump 4, there is a pressure controller 11 which controls the pressure level during normal engine operation and returns excess fuel via the relief line 14 to the tank 3. In the relief line 14, there is a magnetic valve 10 which is closed when the pressure storage device 25 is connected for increasing the pressure level. For supplying fuel to the pressure storage device, a feed line 23 branches off the supply line 8 downstream of the pressure controller 11 and is connected to the pressure storage device 25 via the multi-way valve 28. The storage device 25 can be charged by the pump with fuel, depending on the storage pressure, anytime excess fuel is provided as for example during engine braking operation. For controlling the fuel pressure in an operating phase with increased operating pressure a variable throttle 26 is arranged in the connecting line 24 of the pressure storage device 25.

The operation of the pressure storage device 25 for high pressure operation is controlled by a control unit 21, which, via signal lines 33, is in communication with a pressure sensor 22 in the pressure line 8 and a pressure sensor 22' at the outlet of the pressure storage device 25 for sensing the fuel pressure therein. Depending on the acquired data, the control unit 21 controls the pressure in the pressure line 8 by adjusting the variable throttle 26. For controlling the formation of the fuel/air mixture, the control unit 21 is connected by control lines 35 to the injectors 2 and adapts, by a suitable variation of the injection parameters, particularly the injection time, the measured actual values of the pressure conditions to form an optimal mixture. For adapting the fuel injection times of the injectors 2, the control unit utilizes stored data of a flow performance graph. For adjusting the pressure level in the pressure line 8, in place of a variably adjustable throttle 26, a controllable fuel pump 4 may be provided which is controllable by the control unit 21.

FIG. 3*b* shows an alternative embodiment of a fuel supply arrangement 1 with a pressure storage device 25 which can be connected for increasing the fuel injection pressure level, wherein, for controlling the pressure level in the pressure line 8, two pressure controllers 11, 12 are arranged in parallel branches of the pressure line 8. The line branch, in which the pressure controller 11 for the low pressure level is arranged, includes a magnetic valve 10 for closing this branch during operation at an increased operating pressure, whereby fuel flows through the bypass line 17 and the pressure controller 12 arranged therein for supplying the fuel to the injectors 2 at the increased pressure level. The branch supplying the fuel at lower pressure during normal operation is secured by a check valve 16'.

In the embodiments with pressure storage devices, which are particularly advantageous with regard to construction expenditures, the pressure storage device 25 is so selected that, taking into consideration the fuel volume, the increased pressure level is available during the whole startup phase of the internal combustion engine. The pressure storage device is provided with a pressure sensor 22 or a pressure switch by way of which the engine can also be started at the lower pressure level if this should become necessary. During operation of the internal combustion engine, a switchover between two pressure levels for the fuel injection pressure is possible; the programming of transition functions during switchover between the pressure levels in the control unit of the internal combustion engines is not necessary.

Figure 4A:
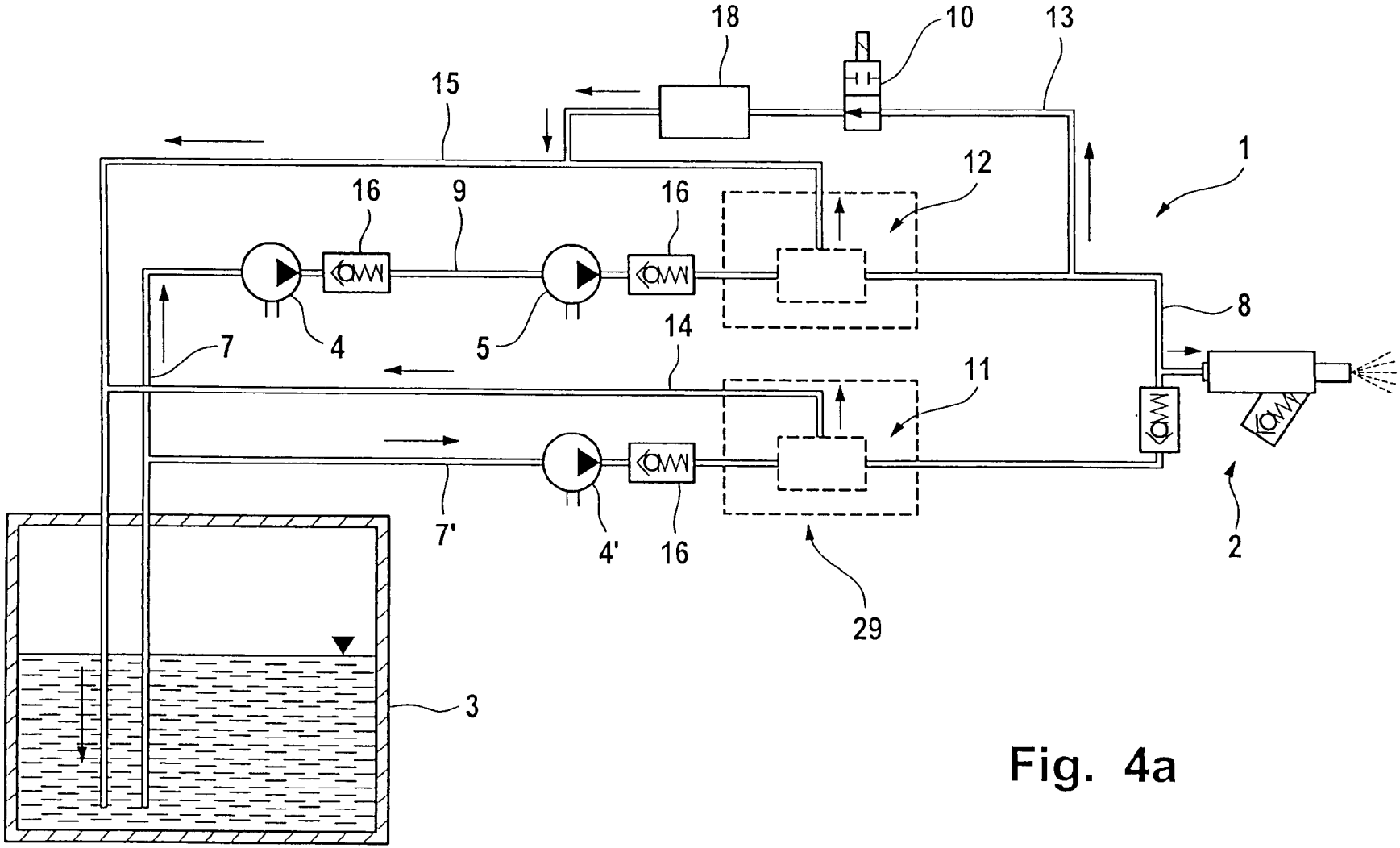
FIGS. 4*a*, 4*b* show fuel supply arrangements with two pressure generating units arranged in parallel.
Figure 4B:
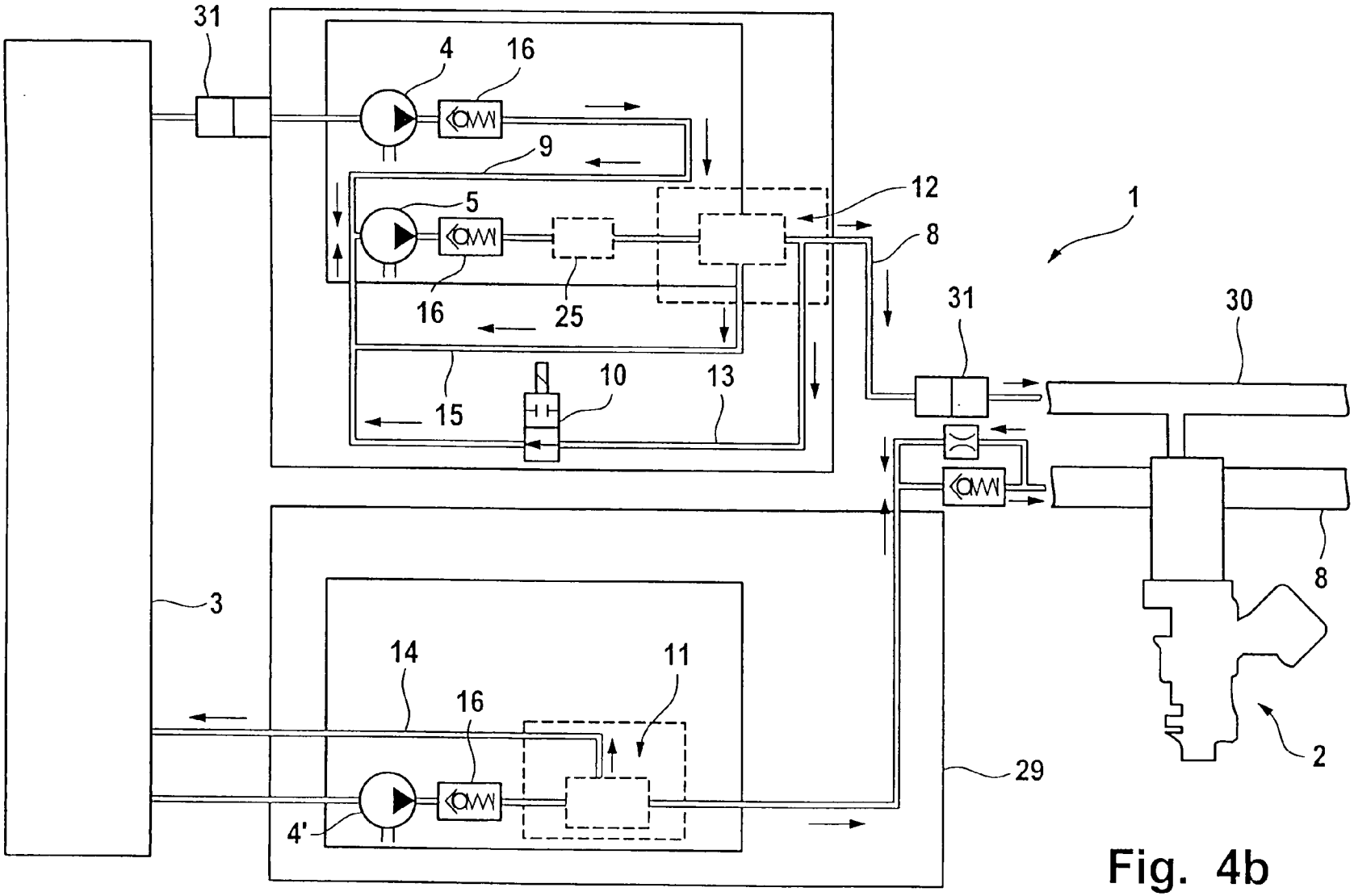

FIGS. 4*a* and 4*b* show fuel supply arrangements 1 with serially arranged fuel pumps 4, 5 and a second pressure generating unit parallel to the fuel pump 43, which includes a fuel pump 4' for the lower pressure level. The second pressure generating unit 29 includes a pressure controller 11 for the lower normal pressure of the fuel injection, the relieved fuel of which is returned to the tank 3 via a return line 14. The pump arrangement with the low pressure pump 4 and the serially arranged downstream high pressure fuel pump 5 is provided with a pressure controller 12 for the higher fuel pressure level of the high pressure fuel pump 5. Downstream of the pressure controller 12, a relief line 13 is connected to the pressure line 8 so that it can be opened by a magnetic valve 10. The relief line 13 may lead to the pressure-free return line 15 to the fuel tank 3 or, as shown in FIG. 4*b*, to the low pressure section 9 of the pressure line 8 between the fuel pumps 4 and 5. With this embodiment of the fuel supply arrangement 1, a pressure limit valve 18 as shown in FIG. 4*a* is not necessary, as the connection of the relief line 13 to the pressure-free return line 15 results in a fast pressure reduction during switch over from an operation with a high fuel injection pressure to normal pressure operation.

FIG. 4*b* shows a fuel supply arrangement with serially arranged fuel pumps 4, 5 and a second pumping unit 29 parallel to the fuel pumps 4, 5, wherein the pressure line 8 for supplying fuel to the injectors 2 includes a separate high pressure rail 30. The pump unit including the pumps 4, 5 for generating the high fuel pressure can be rapidly connected to the other arrangement components by rapid switches 31.

Figure 5A:
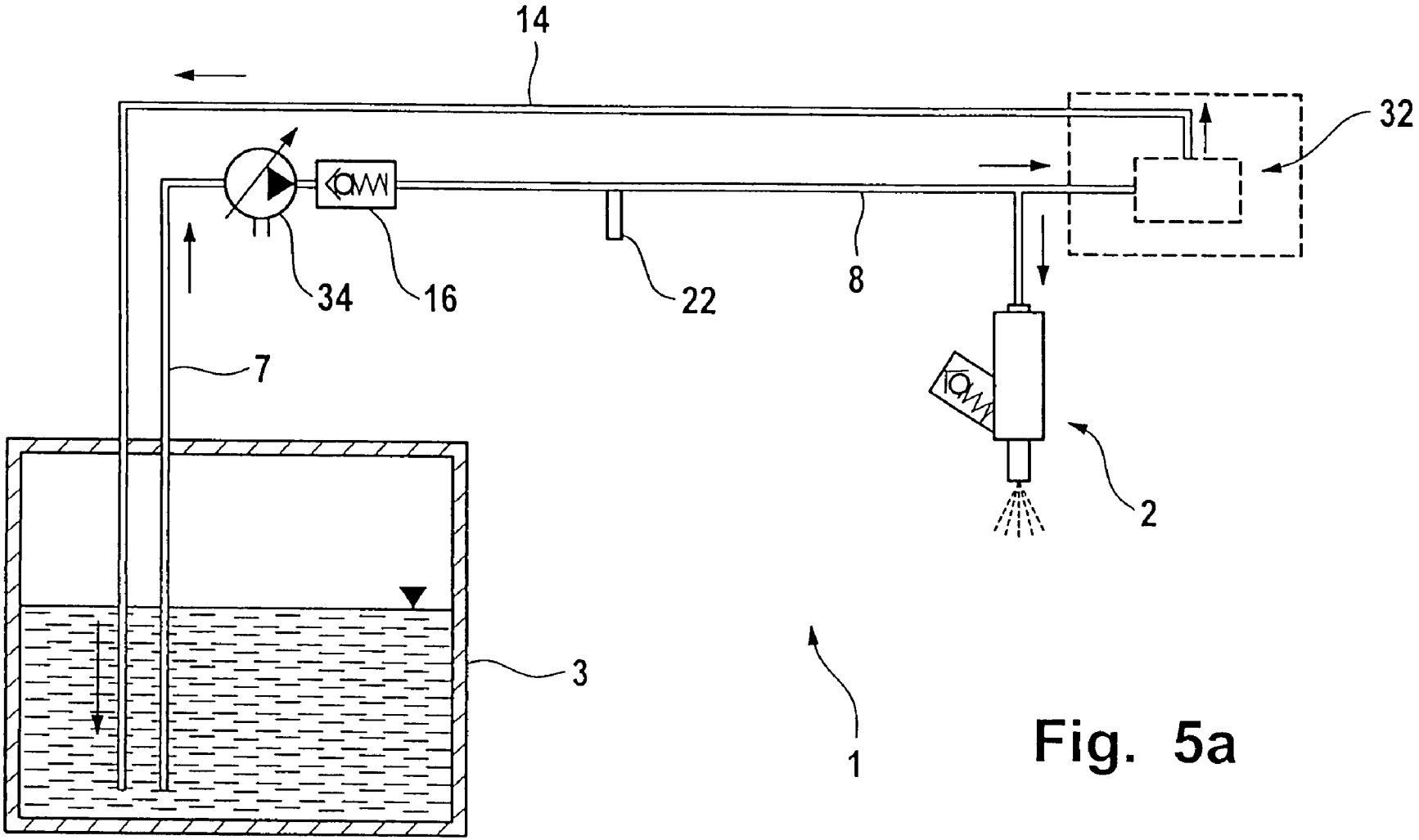
FIGS. 5*a*, 5*b* show fuel supply arrangements with a controllable fuel pump serving as pressure generating unit.
Figure 5B:
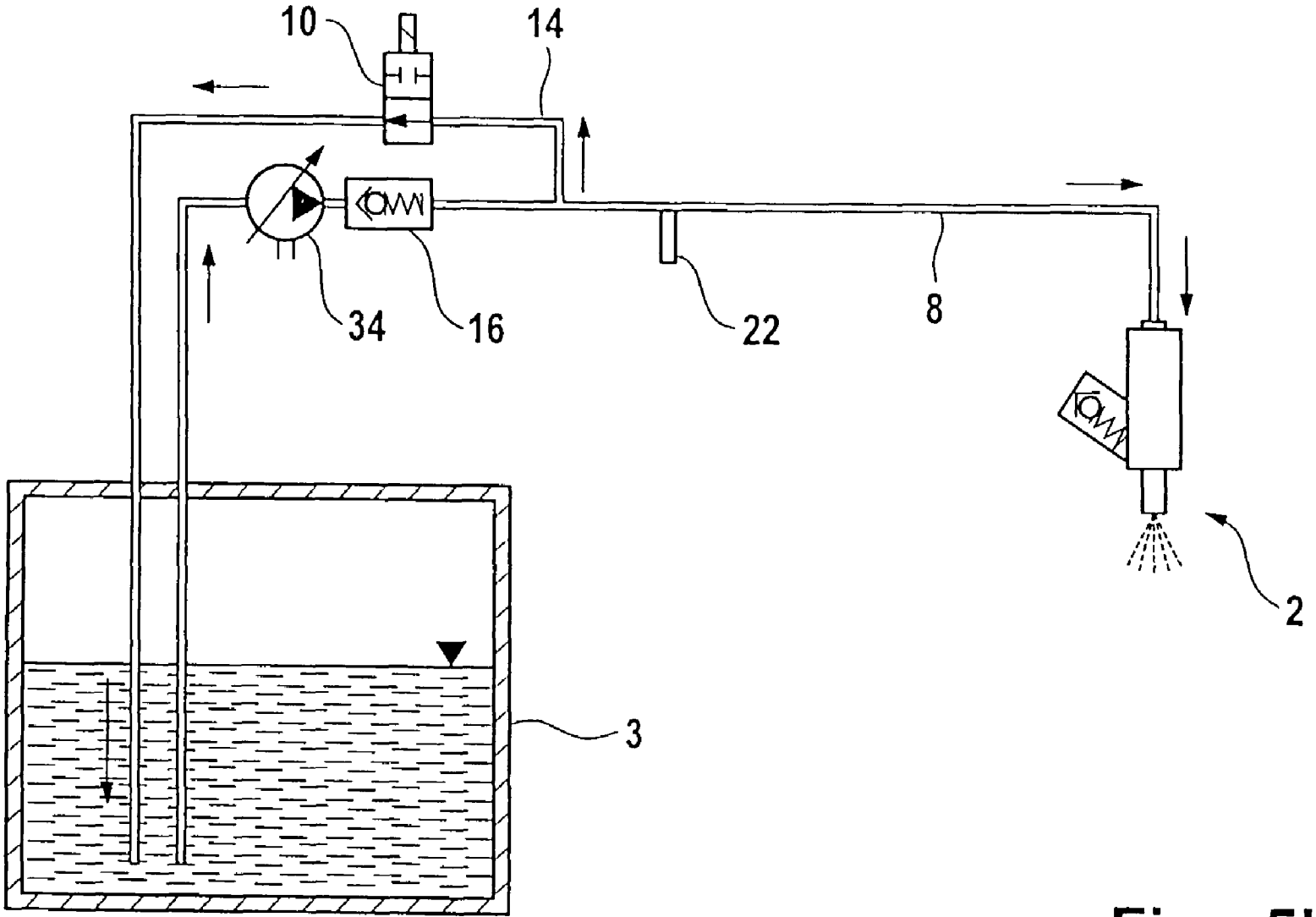

In the fuel supply arrangement as shown in FIGS. 5*a* and 5*b*, a controllable fuel pump 34 is provided in the pressure line 8 for increasing the fuel injection pressure. Depending on the control signals of a control unit which is not shown in FIGS. 5*a* and 5*b*, the fuel pump 34 generates the desired fuel pressure level in the pressure line 8, which leads to the injectors 2 and includes a check valve 16 to prevent return flow of fuel. The control valve for controlling the fuel pump 34 is provided by the injection pressure which is determined by a pressure sensor 22 arranged at the pressure line 8 and which is supplied to the control unit for the fuel pump 34. As shown in FIG. 5*a*, a pressure control valve 32 is provided in the fuel supply line 8, which is electronically controlled and returns excess fuel to the tank 3 via a return line 14. FIG. 5*b* shows an expedient variant of a fuel supply arrangement with a controllable fuel pump 34, wherein the return line 14 for the excess fuel is connected to the fuel supply line 8 upstream of the injector 2 and includes a magnetic valve 10. For reducing the fuel pressure during switch-over from an operation with a higher fuel injection pressure level to an operation with a lower fuel injection pressure level, the magnetic valve 10 is opened and the required fuel injection pressure is controlled by controlling the fuel pump 34.

The arrangements for providing controllably a higher fuel injection pressure level permits an operation with increased fuel pressure during startup and warmup operation of the engine without detrimentally affecting normal engine operation. It also permits multiple injections for improving exhaust gas emissions. With the use of pressure storage devices, the ideal fuel pressure can be provided instantly upon startup of the engine that is already with the first ignition as high pressure fuel is instantly available. The increase of the fuel pressure level—when needed—by a switchable arrangement may also be utilized in the high load ranges of the internal combustion engine in order to supply sufficient fuel to the engine by providing an increased injection pressure during higher fuel requirements. The embodiment of the fuel supply arrangement with parallel pressure generating units also offers the possibility to operate the engine with different types of fuel.

What is claimed is:

1. A fuel supply arrangement for supplying fuel to fuel injectors (2) of an internal combustion engine, comprising a fuel tank (3), a fuel pumping unit including at least two electrically operated fuel pump (4, 5) connected to the fuel tank (3) by way of a fuel supply line (7) and to the fuel injectors (2) via a pressure line (8) for supplying fuel under pressure to the fuel injectors (2), a first fuel pump (4) of the electrically operated fuel pumps (4, 5) for providing fuel at a relatively low pressure level suitable for normal engine operation and a second high pressure fuel pump (5) arranged serially with the first fuel pump (4) providing fuel at a pressure level higher than the low pressure level for engine operation below a predetermined temperature level during engine startup and warm-up operation, a pressure relief line (13) connected to the fuel pressure line (8) downstream of the high pressure pump (5) for releasing pressurized fuel or supplying low pressure fuel to the injector bypassing the high pressure fuel pump (5), and means for controlling activation of the high pressure fuel pump (5) depending on the position of a controllable magnetic blocking valve (10) arranged in the pressure relief line (13) for blocking the pressure relief line (13) when the high pressure fuel pump is activated, and a return line (15) connected to the pressure line (8) downstream of the high pressure pump (5) and including a pressure controller (12) for returning excess fuel to the upstream side of the high pressure fuel pump (5) under the control of the pressure controller (12) for controlling the fuel pressure in the pressure line (8) during start-up operation, said magnetic blocking valve (10) being operable for rapid pressure relief in the supply line (B) upon switchover from startup to normal engine operation.

2. A fuel supply arrangement according to claim 1, wherein the high pressure pump (5) is provided with a bypass line (17) including a check valve (16).

3. A fuel supply arrangement according to claim 1, wherein the relief line (13) is connected to a pressure limiting device (11) providing in the pressure line (8) a lower pressure level for normal engine operation.

4. A fuel supply arrangement according to claim 3, wherein the pressure limiting device (11) is a pressure controller.

5. A fuel supply arrangement according to claim 3, wherein the pressure line (8) is a common rail line connected to several injectors (2) and the pressure limiting device (11) is a pressure limit valve (18) arranged at the downstream end of the common rail line.

6. A fuel supply arrangement for supplying fuel to fuel injectors (2) of an internal combustion engine, comprising a fuel tank (3) a fuel pumping arrangement including an electrically operated fuel pump (4) connected to the fuel tank (3) by way of a fuel supply line (7) including a check valve (16) and to the fuel injectors (2) via a pressure line (8) for supplying fuel under pressure to the fuel injectors (2), the fuel pumping arrangement further including, for increasing the fuel injection pressure, a pressure storage device (25) which is selectively connected by way of a valve (22) and a feed line (23) to the fuel pressure line (8) and via, a connecting line (24) including a variably adjustable throttling member (26), to the fuel pump (4) for controlling the fuel pump inlet pressure and, accordingly, the pressure of the fuel supplied to the injector (2).

7. A fuel supply arrangement according to claim 6, wherein the pressure storage device (25) is connected to the pressure line (8) downstream of a pressure controller (11) disposed in the fuel supply line (8) and providing normally the low fuel pressure level for normal engine operation.

8. A fuel supply arrangement according to claim 7, wherein a return line (14) is connected to the pressure controller (11) and a blocking device (10) is disposed in the return line (14) for increasing the fuel injection pressure level.

9. A fuel supply arrangement according to claim 6, wherein the fuel pump (4) is a controllable pump for controlling the pumping volume and pressure of the fuel supplied by the fuel pump.

10. A fuel supply arrangement according to claim 6, wherein pressure sensors (22) are connected to at least one of the pressure storage device (25) and the pressure line (8) and connected to a control unit (21) which, via an output thereof, is in communication by control lines (35) with the injectors (2) for controlling the fuel injection procedure.

11. A fuel supply arrangement according to claim 6, wherein a second pressure generating unit (29) is connected parallel, to the pumping arrangement which includes a fuel pump (4') providing a low pressure fuel for normal engine operation.

12. A fuel supply arrangement according to claim 6, wherein a pressure relief line (14) extends to the fuel tank (3) for returning excess fuel to the fuel tank (3).

* * * * *